US006350324B1

(12) United States Patent
Waeckerle et al.

(10) Patent No.: US 6,350,324 B1
(45) Date of Patent: Feb. 26, 2002

(54) SOFT MAGNETIC ALLOY

(75) Inventors: Thierry Waeckerle, Nevers; Lucien Coutu; Laurent Chaput, both of Sauvigny les Bois, all of (FR)

(73) Assignee: Imphy Ugine Precision, Puteaux (FR)

( * ) Notice: Subject to any disclaimer, the term of this patent is extended or adjusted under 35 U.S.C. 154(b) by 0 days.

(21) Appl. No.: 09/535,740

(22) Filed: Mar. 27, 2000

(30) Foreign Application Priority Data

Apr. 2, 1999 (FR) ..... 99 04302

(51) Int. Cl.[7] ..... H01F 1/047

(52) U.S. Cl. ..... 148/311; 148/310; 148/442; 420/452; 420/585

(58) Field of Search ..... 148/310, 311, 148/315, 442; 420/452, 585

(56) References Cited

U.S. PATENT DOCUMENTS 3,865,581 A * 2/1975 Sekino et al.
3,925,065 A * 12/1975 Osawa et al.
4,131,494 A 12/1978 Momose et al.
5,783,145 A * 7/1998 Coutu et al. ..... 420/94

FOREIGN PATENT DOCUMENTS

| | | | | |
|---|---|---|---|---|
| EP | 0889 488 | | 1/1999 | |
| EP | 0827 256 | | 3/1999 | |
| GB | 504854 | | 5/1939 | |
| JP | 57-41353 | * | 3/1982 | ..... 420/452 |

* cited by examiner

*Primary Examiner*—John Sheehan
(74) *Attorney, Agent, or Firm*—Oblon, Spivak, McClelland, Maier & Neustadt, P.C.

(57) ABSTRACT

Soft magnetic alloy of the iron-nickel type, the chemical composition of which comprises, in % by weight: $34\% \leqq Ni \leqq 40\%$; $7\% \leqq Cr \leqq 10\%$; $0.5\% \leqq Co \leqq 3\%$; $0.1\% \leqq Mn \leqq 1\%$; $O \leqq 0.007\%$; $S \leqq 0.002\%$; $N \leqq 0.004\%$; with $N+S+O \leqq 0.01\%$; iron and impurities 5 resulting from the production process. Use in motors especially suited for use in horology.

20 Claims, No Drawings

SOFT MAGNETIC ALLOY

BACKGROUND OF THE INVENTION

1. Field of the Invention

The invention relates to an economical soft magnetic alloy with good temperature stability of the magnetic permeability and good resistance to oxidation in a damp environment. This alloy can be used, preferably, to manufacture the stator of an electric stepping micromotor for use in horology (the science of measuring time).

2. Description of the Background

Electric micromotors for use in horology comprise a stator, generally made of soft magnetic alloy containing about 80% nickel, a few percent of molybdenum or copper, the remainder being iron. An alloy of this kind has a maximum magnetic permeability of 200,000 to 300,000 across the entire range of operating temperatures (−20° C., +60° C.) and micromotors manufactured in this way therefore consume very little energy. However, alloys containing 80% nickel are expensive and readily oxidize in damp environments, and this presents a number of drawbacks: they are awkward to use in certain hot and humid regions; they are ill-suited to the manufacture of timepieces in which the mechanism is visible; and they are too expensive to use in the manufacture of economical timepieces.

In order to remedy these drawbacks, it has been proposed that alloys containing 80% nickel be replaced with alloys of the iron-nickel-chromium type containing less than 50% nickel and a few percent chromium for the manufacture of motors for timepieces. However, the alloys proposed generally have a magnetic permeability which is both too low and too sensitive to temperature. This excessive sensitivity of the magnetic permeability to temperature is a drawback. This is because the motor of a timepiece needs to operate satisfactorily between −20° C. and +60° C., which means that the magnetic permeability must not vary too much across this temperature range.

Bearing in mind all the constraints imposed on a stepping micromotor for use in horology, it is desirable for the manufacture of the stator of an economical motor of this type, to have a soft magnetic alloy with a magnetic flux density at saturation Bs greater than or equal to 5000 gauss (0.5 tesla), a maximum relative DC permeability $\mu_{DCmax}$ greater than 70,000, sufficient resistivity ρ that $\mu_{DCmax}\times\rho>0.05\ \Omega.m$, sufficient stability of the magnetic permeability $\mu_{DCmax}$ between −20° C. and +60° C., improved resistance to oxidation and a relatively low nickel content. For the magnetic permeability to have sufficient stability, it is desirable that its variation, in terms of relative values, with respect to its value at 20° C. remain lower than 30% across the temperature range considered.

OBJECTS OF THE INVENTION

Objects of the present invention include the provision an alloy which meets the above requirements, and the manufacture and use of such an alloy.

SUMMARY OF THE INVENTION

To this end, one embodiment of the invention is a soft magnetic alloy, the chemical composition of which comprises, consists of or consists essentially of in % by weight based on total weight:

$34\% \leqq Ni \leqq 40\%$ $7\%\ Cr \leqq 10\%$ $0.5\% \leqq Co \leqq 3\%$ $0.1\% \leqq Mn \leqq 1\%$ as well as iron and the usual impurities which result from the production process.

Preferably the impurities represented by O, S and N if present are such that:

$O \leqq 0.007\%$ $S \leqq 0.002\%$ $N \leqq 0.004\%$ and:

$N+S+O \leqq 0.01\%$.

It is also preferable that the impurities Si, Al, Ca and Mg if present be such that:

$Si \leqq 0.3\%$ $Al \leqq 0.05\%$ $Ca \leqq 0.03\%$ $Mg \leqq 0.03\%$ and that:

$Si+Al+Ca+Mg+Mn \leqq 1\%$

This alloy can be used in all applications known for soft magnetic alloys and preferably for the manufacture of a magnetic yoke and, in particular, the manufacture of the stator of an electric stepping micromotor for use in horology.

DESCRIPTION OF THE PREFERRED EMBODIMENTS

The invention will now be described in greater detail and illustrated by some examples.

The chemical composition of the invention soft magnetic alloy preferably comprises, consists of or consists essentially of, in % by weight based on total weight:

- more than 34% nickel, in order to obtain sufficient magnetic flux density at saturation and magnetic permeability. However, to obtain an economical alloy, and in particular, bearing in mind the addition of chromium, the nickel content preferably is below 40%,
- from 7% to 10% chromium, to improve the resistance to oxidation and increase the low-temperature magnetic permeability; when the nickel content is between 34% and 40%, a chromium content such as this appreciably improves the magnetic permeability between −40° C. and 0° C.,
- from 0.5% to 3% cobalt, to obtain sufficient temperature stability of the magnetic permeability. Specifically, the inventors have found, unexpectedly, that for nickel contents of between 34% and 40% and chromium contents of between 7% and 10%, a modest addition of cobalt appreciably improved the temperature stability of the magnetic permeability between −20° C. and 60° C.,
- from 0.1% to 1% manganese, and preferably more than 0.2%, to deoxidize the alloy and fix any sulfur.
- the remainder of the composition comprises, consists of, or consists essentially of iron and of the usual impurities that result from the production process.

The impurities may be, in particular, oxygen, sulfur, nitrogen, silicon, aluminum, calcium and magnesium.

All of these impurities have a prejudicial effect on the magnetic properties and so, in order to obtain desirable magnetic properties, it is preferable that:

- the oxygen content remain below or equal to 0.007%, the nitrogen content remain below or equal to 0.004%, the sulfur content remain below or equal to 0.002%, and the sum O+N+S of the oxygen, nitrogen and sulfur contents, remain below or equal to 0.01 %;

the residual contents of deoxidizing elements such as Si, Al, Ca, Mg remain below or equal to 0.3% in the case of silicon, 0.05% in the case of aluminum, and 0.03% in the case of calcium or magnesium; calcium and magnesium have the advantage of allowing the formation of small oxides which make the alloy easier to cut.

Furthermore, it is preferable for the sum Mn+Si+Al+Ca+Mg of the manganese, silicon, aluminum, calcium and magnesium contents to remain below or equal to 1%.

The contents of other impurities such as phosphorus and boron should also remain as low as possible.

The invention alloy thus defined, which is of Fe—Ni—Cr—Co type, can be hot rolled then cold rolled and optionally annealed under hydrogen at a temperature of 900° C. or higher for more than an hour, preferably between 1100° C. and 1200° C. for 1 to 4 hours. The high-temperature annealing under hydrogen has the advantage of at least partially eliminating certain sulfide or nitride precipitates which have a prejudicial effect on the magnetic properties.

The invention alloy preferably has a magnetic flux density at saturation Bs higher than 5000 gauss at 70° C., a maximum relative DC magnetic permeability $\mu_{DCmax}$ greater than 70,000 at 20° C., an electrical resistivity ρ greater than 70 μΩ.cm at 20° C., and temperature stability of the maximum relative magnetic permeability defined for a temperature T by:

$$|\Delta\mu_{DCmax}(T)/\mu_{DCmax}(20^\circ\ C.)| \leqq 30\%$$

In this formula, $\Delta\mu_{DCmax}(T)$ represents the variation in $\mu_{DCmax}$ between 20° C. and T, and $\mu_{DCmax}(20^\circ\ C.)$ represents the DC permeability at 20° C.

Furthermore, given its chromium content, the invention alloy has good resistance to oxidation in damp environments.

EXAMPLES

By way of example, washers with a 20 mm inside diameter and 30 mm outside diameter were made, some being cut from cold-rolled strip 0.6 mm thick made of alloys according to the invention and some being made of alloys given by way of comparison and produced by smelting pure raw materials under vacuum. The washers were annealed under hydrogen at 1170° C. for 4 hours. The magnetic flux density at saturation Bs was measured at 70° C, the coercive field Hc was measured at 20° C, the electrical resistivity p was measured at 20° C, the maximum relative DC magnetic permeability /.z,, was measured at 20° C. and the maximum value of its relative variation I /D&, (T)/iDcn,l,(²O° C)I was measured in the temperature range - 20° C, +60° C. (as an abbreviation, this maximum variation is denoted A,L//z).

The chemical compositions of alloys 1 to 4, corresponding to the invention, and 5 to 17 given by way of comparison, are shown in Table 1, and the magnetic characteristics as shown in Table 2.

TABLE 1

| Ref | Ni | Cr | Co | Mn | C | Si | P | N | O | S | N + O + S |
|---|---|---|---|---|---|---|---|---|---|---|---|
| 1 | 35.79 | 8.92 | 3.03 | 0.29 | 0.009 | 0.03 | 0.002 | 0.001 | 0.0069 | 0.0005 | 0.0084 |
| 2 | 37.45 | 8.72 | 3.06 | 0.3 | 0.0089 | 0.03 | 0.002 | 0.0012 | 0.0068 | 0.0005 | 0.0085 |
| 3 | 37.75 | 9.54 | 1.02 | 0.3 | 0.0091 | 0.03 | 0.002 | 0.0007 | 0.0062 | 0.0005 | 0.0074 |
| 4 | 39.49 | 9.6 | 1.02 | 0.287 | 0.0096 | 0.021 | 0.003 | 0.0029 | 0.0029 | 0.001 | 0.0068 |
| 5 | 35.8 | 9.05 | 1.04 | 0.3 | 0.0083 | 0.03 | 0.002 | 0.0005 | 0.009 | 0.0005 | 0.0100 |
| 6 | 37.63 | 9.31 | 0.5 | 0.293 | 0.0086 | 0.01 | 0.003 | 0.0027 | 0.009 | 0.0008 | 0.0125 |
| 7 | 37.95 | 9.56 | 1.42 | 0.289 | 0.0083 | 0.017 | 0.003 | 0.003 | 0.0084 | 0.0009 | 0.0123 |
| 8 | 36.54 | 9.03 | 0.096 | 0.306 | 0.006 | 0.164 | 0.007 | 0.0027 | 0.008 | 0.0014 | 0.0121 |
| 9 | 36.97 | 9.02 | 0.04 | 0.293 | 0.0046 | 0.15 | 0.0057 | 0.0027 | 0.010 | 0.002 | 0.0147 |
| 10 | 37.82 | 8.95 | 0.002 | 0.48 | 0.005 | 0.013 | 0.004 | 0.0042 | 0.0066 | 0.0042 | 0.0150 |
| 11 | 35.85 | 5.89 | 2.85 | 0.308 | 0.0083 | 0.031 | 0.0034 | 0.0006 | 0.0052 | 0.0005 | 0.0063 |
| 12 | 37.69 | 3.14 | 1.06 | 0.296 | 0.009 | 0.031 | 0.0035 | 0.0005 | 0.0057 | 0.0005 | 0.0067 |
| 13 | 37.74 | 5.76 | 0.97 | 0.308 | 0.0092 | 0.033 | 0.0038 | 0.0008 | 0.0058 | 0.0005 | 0.0071 |
| 14 | 35.77 | 5.6 | 1.01 | 0.306 | 0.0094 | 0.035 | 0.004 | 0.0008 | 0.0075 | 0.0005 | 0.0088 |
| 15 | 37.77 | 5.8 | 2.87 | 0.287 | 0.0069 | 0.033 | 0.0037 | 0.0009 | 0.0083 | 0.0005 | 0.0097 |
| 16 | 33.96 | 2.64 | 1.90 | 0.259 | 0.0089 | 0.032 | 0.0035 | 0.0051 | 0.0095 | 0.0005 | 0.0141 |
| 17 | 37.86 | 10.55 | 0.96 | 0.299 | 0.0049 | 0.019 | 0.003 | 0.0027 | 0.014 | 0.001 | 0.0177 |

TABLE 2

| Ref. | Bs(G) | Hc(Oe) | ρ(μΩ.cm) | $\mu_{DCmax}$ | Δμ/μ(%) |
|---|---|---|---|---|---|
| 1 | 5800 | 27.4 | 92 | 92700 | 26 |
| 2 | 6800 | 24.5 | 94.4 | 87500 | 16 |
| 3 | 6000 | 21.9 | 93.2 | 95400 | 9 |
| 4 | 6500 | 20.6 | 98.5 | 72000 | 2 |
| 5 | 4800 | 23.9 | 91.1 | 70000 | 16 |
| 6 | 5500 | 22 | 92.9 | 67000 | 4 |
| 7 | 5800 | 25.7 | 93.5 | 67000 | 12 |
| 8 | 4300 | 23.3 | 95 | 78400 | 55 |
| 9 | 4700 | 22 | 96 | 67000 | 37 |
| 10 | 5400 | 15.5 | 95 | 76500 | 48 |
| 11 | 8400 | 45.4 | 90.9 | 53200 | 53 |
| 12 | 11000 | 54.3 | 82.6 | 54200 | 33 |
| 13 | 8700 | 33.9 | 90.2 | 83600 | 54 |
| 14 | 7600 | 44.5 | 90.5 | 49700 | 65 |
| 15 | 9400 | 44.2 | 90.9 | 57900 | 61 |
| 16 | 9200 | 85 | 83.5 | 20200 | 60 |
| 17 | 4700 | 21.9 | 96.2 | 62000 | 57 |

A comparison between specimens 1 to 7 on the one hand and 8 to 17 on the other, shows that an addition of 0.5% to 3% cobalt, combined with a nickel content of between 34% and 40% and a chromium content of between 7% and 10% very appreciably improves the temperature stability Δμ/μ of the DC magnetic permeability. In particular, specimens 8 to 10, which have nickel and chromium contents in accordance with the invention, but which contain practically no cobalt, always have a Δμ/μ value higher than 30, whereas in the case of specimens 1 to 7, Δμ/μ is always lower than 30.

Likewise, specimens 11 to 17, which contain cobalt, but in which the chromium contents are outside the limits of the invention, have Δμ/μ values higher than 30.

In another comparison, specimens 1 to 4 (in accordance with the invention), the oxygen contents of which are below 0.007% and the sums of the nitrogen, oxygen and sulfur contents of which are below 0.01%, have a magnetic flux density at saturation Bs higher than 5000 gauss and a maximum relative DC magnetic permeability $\mu_{DCmax}$ higher than 70,000 at 20 ° C., whereas specimens 5 to 7 which do not satisfy the oxygen content or sum N+O+S conditions, have either a magnetic flux density at saturation of below 5000 gauss, or a DC magnetic permeability of less than 70,000 at 20° C. In all cases, the resistivity is higher than 90 $\mu\Omega$.cm; the product $\mu_{DCmax}\times\rho$is greater than 0.05 Ω.m.

Using the alloy according to the invention it is possible to manufacture stators of stepping micromotors for use in horology which are at the same time economical, have good resistance to oxidation in a damp environment, and exhibit good performance. One of ordinary skill in the art is capable of such manufacture.

Because the magnetic flux density at saturation is higher than 5000 gauss, the electromagnetic torque applied to the rotor is always very much higher than the resistive torque.

Because the magnetic permeability is higher than 70,000 (at 20° C.), the magnetic reluctance of the circuit remains low, which makes it possible to use a coil which is not too big.

Because of the high electrical resistivity, the induced currents are limited, thus making it possible to obtain low energy losses.

Because of the presence of more than 7% chromium, the resistance to oxidation is good.

Finally, this alloy is appreciably more economical than alloys containing 80% nickel.

French patent application 99 04302 filed Apr. 2, 1999, is incorporated herein by reference.

What is claimed is:

1. A soft magnetic alloy comprising, in % by weight based on total weight:

34%≦Ni≦40%

7%≦Cr≦10%

0.5%≦Co≦3%

0.1%≦Mn≦1%

O≦0.007%

S≦0.002%

N≦0.004%, the remainder of the composition comprises iron and the usual impurities which result from the production process, and wherein

N+S+O≦0.01%.

2. The alloy as claimed in claim 1, wherein any Si, Al, Ca and Mg impurities are such that:

Si≦0.3%

Al≦0.05%

Ca≦0.03%

Mg≦0.03% and

Si+Al+Ca+Mg+Mn≦1%.

3. The alloy as claimed in claim 2, wherein said alloy has a magnetic flux density at saturation higher than 5000 gauss.

4. The alloy as claimed in claim 2, wherein said alloy has a magnetic flux density at saturation higher than 5000 gauss.

5. The alloy as claimed in claim 1, wherein said alloy has a maximum relative DC magnetic permeability greater than 70,000 at 20° C.

6. The alloy as claimed in claim 2, wherein said alloy has a maximum relative DC magnetic permeability greater than 70,000 at 20° C.

7. The alloy as claimed in claim 1, wherein said alloy has an electrical resistivity greater than 70 $\mu\Psi$.cm at 20° C.

8. The alloy as claimed in claim 2, wherein said alloy has an electrical resistivity greater than 70 $\mu\Psi$.cm at $2^{0\circ}$ C.

9. The alloy as claimed in claim 1, wherein said alloy has a temperature stability of the maximum relative magnetic permeability defined for a temperature T of:

$$|\Delta\mu_{DCmax}(T)/\mu_{DCmax}(20^\circ\ C.)|\leqq 30\%$$

where $\Delta\mu$DCmax(T) represents the variation in $\mu_{DCmax}$ between 20° C. and T, and $\mu_{DCmax}$(20° C.) represents the DC permeability at 20° C.

10. The alloy as claimed in claim 2, wherein said alloy has a temperature stability of the maximum relative magnetic permeability defined for a temperature T of:

$$|\Delta\mu_{DCmax}(T)/\mu_{DCmax}(20^\circ\ C.)|\leqq 30\%$$

where $\Delta\mu_{DCmax}$(T) represents the variation in $\mu_{DCmax}$ between 20° C. and T, and $\mu_{DCmax}$(20° C) represents the DC permeability at 20° C.

11. The alloy as claimed in claim 1, wherein said alloy has magnetic flux density at saturation higher than 5000 gauss, wherein said alloy has a maximum relative DC magnetic permeability greater than 70,000 at 20° C., wherein said alloy has an electrical resistivity greater than 70 $\mu\Omega$.cm at 20° C., and wherein said alloy has a temperature stability of the maximum relative magnetic permeability defined for a temperature T of:

$$|\Delta\mu_{DCmax}(T)/\mu_{DCmax}(20^\circ\ C.)|\leqq 30\%$$

where $\Delta\mu_{DCmax}$(T) represents the variation in $\mu_{DCmax}$ between 20° C. and T, and $\mu_{DCmax}$(20° C.) represents the DC permeability at 20° C.

12. The alloy as claimed in claim 2, wherein said alloy has magnetic flux density at saturation higher than 5000 gauss, wherein said alloy has a maximum relative DC magnetic permeability greater than 70,000 at 20° C., wherein said alloy has an electrical resistivity greater than 70 $\mu\Omega$.cm at 20° C., and wherein said alloy has a temperature stability of the maximum relative magnetic permeability defined for a temperature T of:

$$|\Delta\mu_{DCmax}(T)/\mu_{DCmax}(20^\circ\ C.)|\leqq 30\%$$

where $\Delta\mu_{DCmax}$(T) represents the variation in $\mu_{DCmax}$between 20° C. and T, and $\mu_{DCmax}$(20° C.) represents the DC permeability at 20° C.

13. A magnetic yoke comprising the alloy of claim 1.

14. A magnetic yoke comprising the alloy of claim 2.

15. A stator comprising the alloy of claim 1.

16. A stator comprising the alloy of claim 2.

17. A stator comprising the alloy of claim 11.

18. A stator comprising the alloy of claim 12.

19. An electric motor comprising the alloy of claim 1.

20. An electric motor comprising the alloy of claim 2.

* * * * *